US006041725A

United States Patent [19]

Resta

[11] Patent Number: 6,041,725

[45] Date of Patent: Mar. 28, 2000

[54] APPARATUS FOR AUTOMATICALLY CHANGING BOBBIN CASES IN QUILTING MACHINES

[75] Inventor: Roberto Resta, Faenza, Italy

[73] Assignee: Resta S.r.l., Faenza, Italy

[21] Appl. No.: 09/296,460

[22] Filed: Apr. 22, 1999

[30] Foreign Application Priority Data

Apr. 30, 1998 [IT] Italy ..... B098A0269

[51] Int. Cl.[7] ..... D05B 59/04

[52] U.S. Cl. ..... 112/470.05; 112/180; 112/186

[58] Field of Search ..... 112/470.05, 470.01, 112/180, 186, 279, 117, 118, 119; 242/473.5, 473.6, 473.8

[56] References Cited

U.S. PATENT DOCUMENTS 5,606,927 3/1997 Nakamura et al. ..... 112/470.01

5,775,243 7/1998 Kinoshita et al. ..... 112/186

5,904,110 5/1999 Kwang ..... 112/186

*Primary Examiner*—Peter Nerbun

*Attorney, Agent, or Firm*—Guido Modiano; Albert Josif

[57] ABSTRACT

The apparatus allows to automatically change bobbin cases in quilting machines. The apparatus comprises a pick-up element which is mounted on a carriage which can move between a magazine which contains full cases and a hook assembly of a sewing machine in which an empty case is to be replaced. The pick-up element extracts the empty case and deposits it into a specifically provided container. It is further positioned at the magazine, from which it removes a full case and transfers the case into the hook assembly.

9 Claims, 5 Drawing Sheets

APPARATUS FOR AUTOMATICALLY CHANGING BOBBIN CASES IN QUILTING MACHINES

BACKGROUND OF THE INVENTION

The present invention relates to an apparatus for automatically changing bobbin cases in quilting machines.

It is known that in quilting machines, quilting operations are performed by one or more sewing machines which are installed on a frame which moves with respect to the cloth to be quilted. The sewing machines have a conventional structure, with a head which lies above the cloth and is designed to move the needle that feeds the upper thread and a hook assembly which moves below the cloth synchronously with the needle and around a supporting case which rotatably accommodates a bobbin on which the lower thread is wound; said lower thread, together with the upper one fed by the needle, forms the stitch.

Owing to the high productivity of current quilting machines, the bobbins of the lower thread empty rather quickly and must be replaced frequently with full bobbins. The bobbins are currently usually replaced manually, with prolonged interruptions of the production cycle and considerable reductions in performance.

SUMMARY OF THE INVENTION

The aim of the present invention is to obviate the above mentioned drawbacks by providing an apparatus which allows to automate the replacement of the cases which have empty bobbins with others having full bobbins.

Within the scope of this aim, an object of the present invention is to provide an apparatus which is structurally simple and reliable in operation.

This aim and this object are achieved with an apparatus whose characteristics are defined in the appended claims.

BRIEF DESCRIPTION OF THE DRAWINGS

Further characteristics and advantages of the present invention will become apparent from the following detailed description of a preferred embodiment, illustrated by way of non-limitative example in the accompanying drawings, wherein.

DESCRIPTION OF THE PREFERRED EMBODIMENTS

Figure 1:
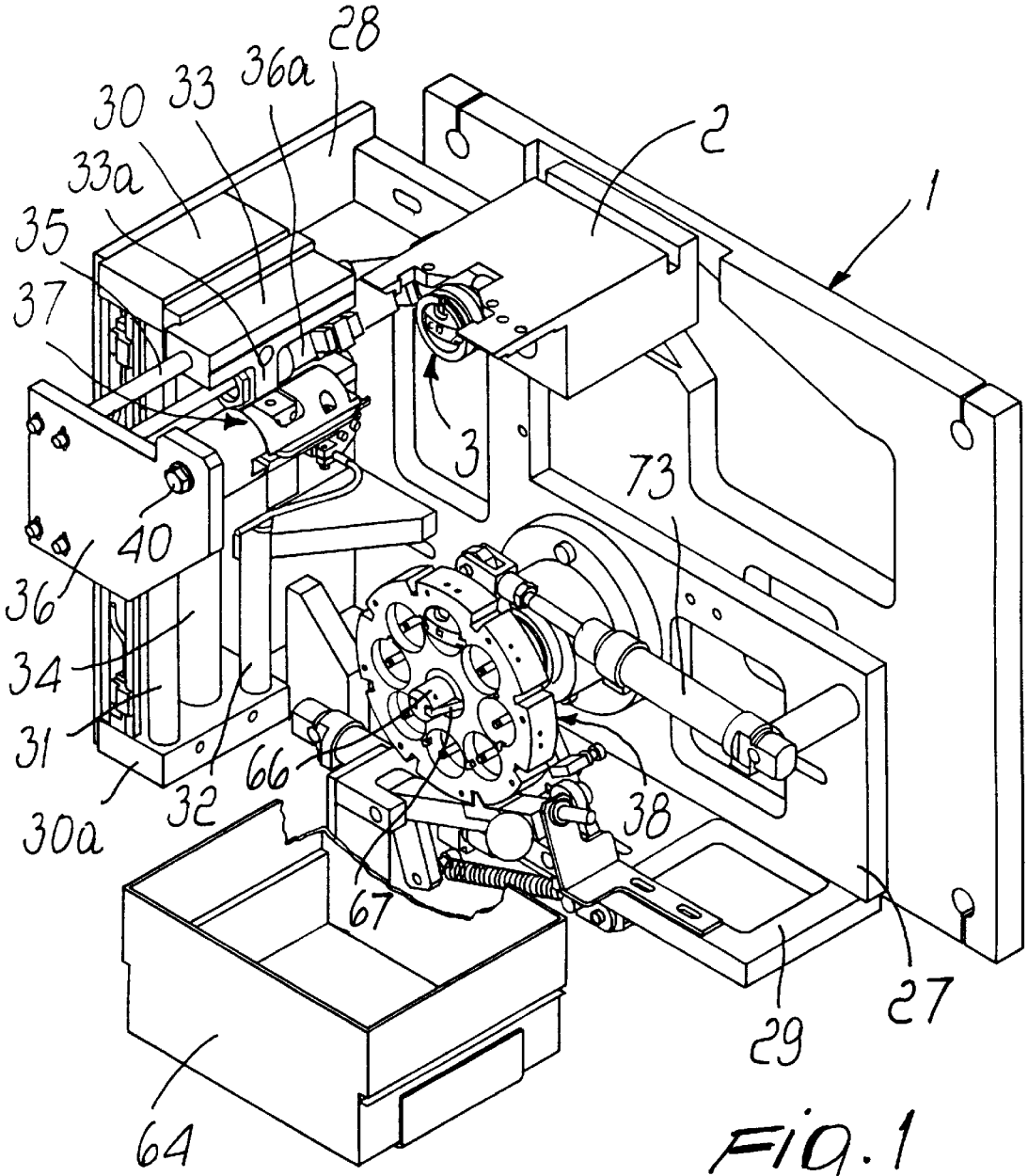
FIG. 1 is a perspective view of the apparatus.
Figure 2:
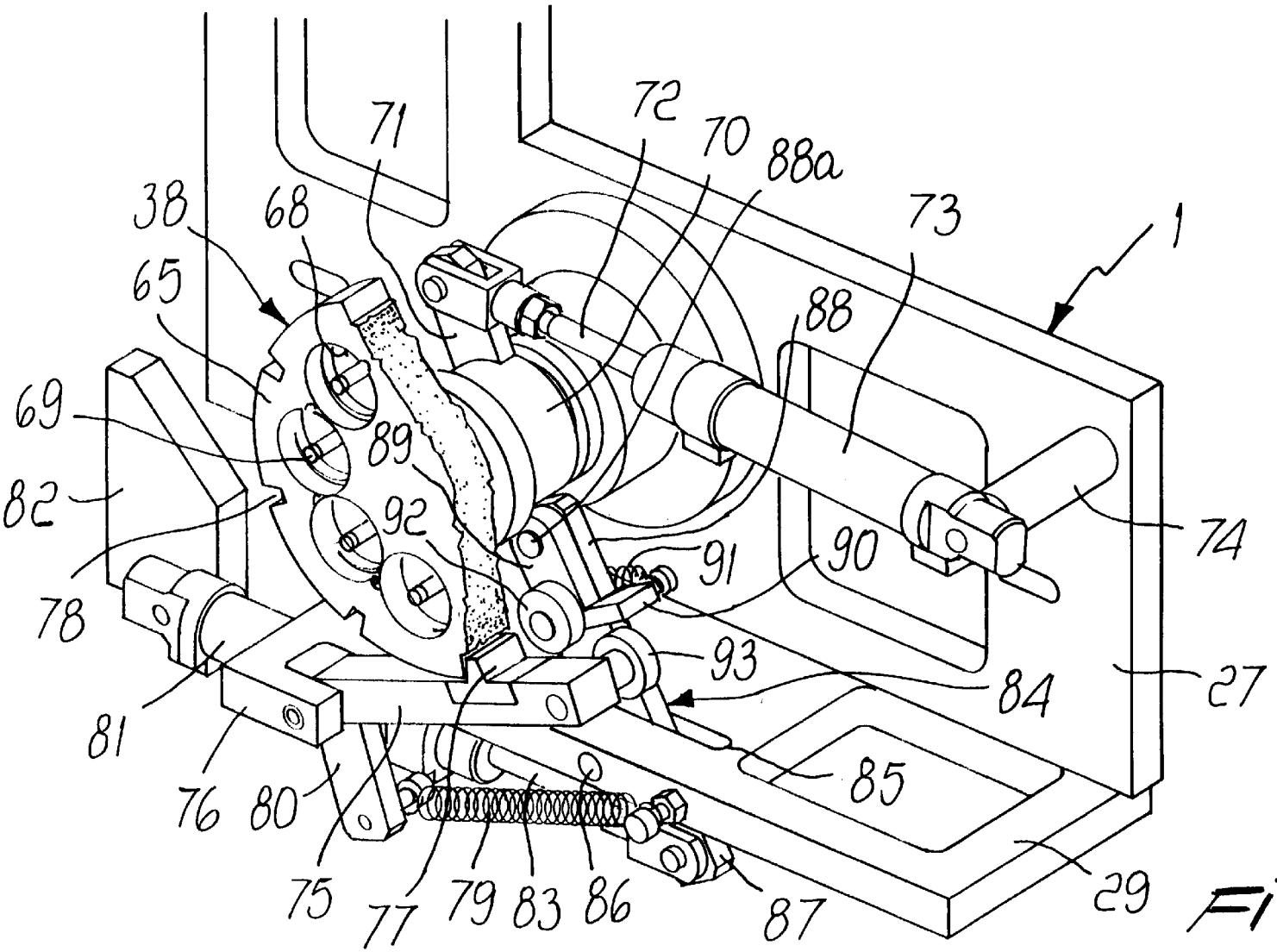
FIG. 2 is a perspective view of a portion of the apparatus of FIG. 1.

With reference to FIGS. 1 and 2, 1 designates a carriage on which a sewing machine which forms the quilting lines is installed. Only the bracket 2 of said machine, which supports the hook assembly generally designated by the reference numeral 3, is shown.

The drawing does not illustrate the sewing head, which is not described since it is fully conventional and not relevant to the present invention.

The hook assembly is also of a conventional type, but it is described briefly hereinafter to allow better comprehension of the elements provided to change the case that supports the bobbin of the lower thread.

Figure 3:
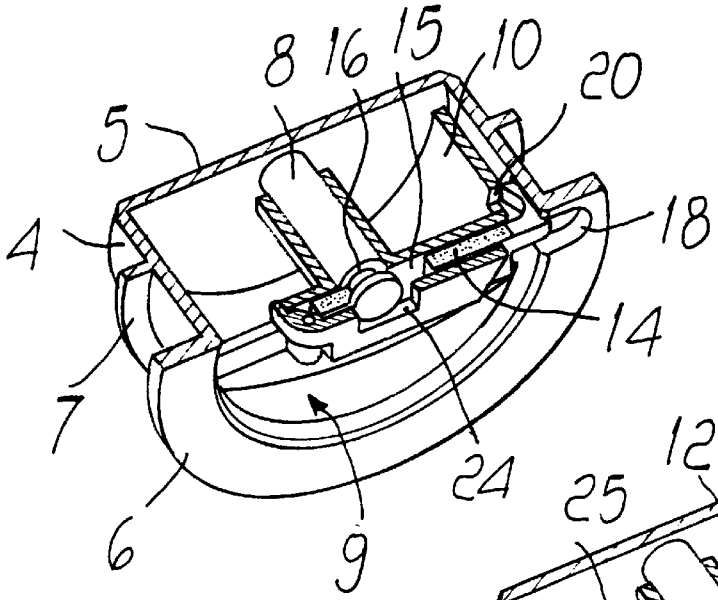
FIG. 3 is a perspective view of the bobbin case in the position for retaining the hook assembly in its seat.
Figure 4:
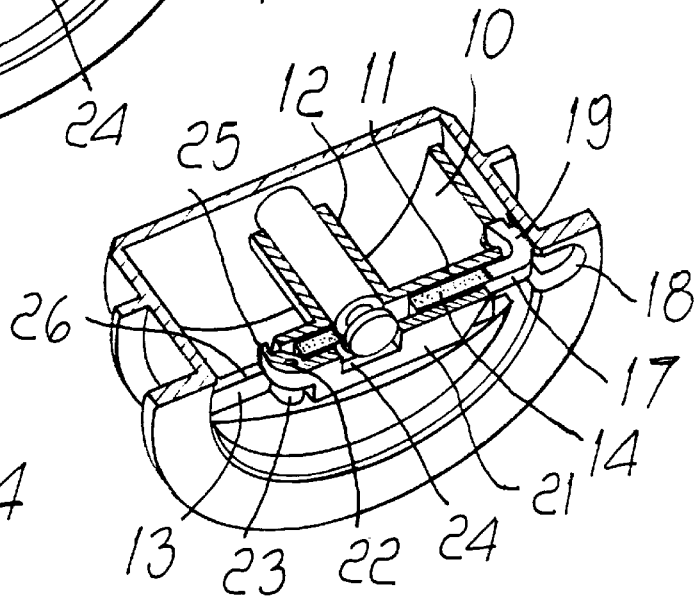
FIG. 4 is a perspective view of the bobbin case in the release position.

The hook assembly 3 (see FIGS. 3 and 4) comprises a cylindrical cup 4 which is fixed to the bracket 2 and has a bottom 5 and a flange 6 which protrudes outwards from the rim of the cup 4. The flange 6 forms, together with an annular ridge 7 which is externally rigidly coupled to the cup 4, an annular channel in which the hook assembly (not shown) rotates; said hook assembly, by cooperating with the needle, forms the stitch.

A pivot 8 is centrally fixed to the bottom 5 of the cup 4, protrudes inside the cup and supports the case 9 for accommodating the bobbin on which the lower thread is wound.

The case 9 comprises a cylindrical tubular portion 10 closed by a circular wall 11 from which a bush 12 protrudes coaxially to the portion 10; the pivot 8 for supporting the case 9 inside the cup 4 enters said bush.

The bush 12, the wall 11 and the tubular portion 10 define a compartment for accommodating the bobbin (not shown). The bobbin is constituted by a spool on which the lower thread is wound and which can rotate about the bush 12.

The case 9, once inserted in the cup 4, is locked both rotationally and axially. For this purpose, a diametrical notch 13 is formed in the wall 11 and slidingly accommodates a tab 14. In order to prevent the tab 14 from protruding from the notch 13, its longitudinal edges are slideable in respective slots formed in the sides of the notch 13.

The tab 14 has, in a median position, a slot 15 through which the end of the pivot 8 protrudes when the case 9 has been fitted in the cup 4. By means of a spring (not shown in the drawings), the tab 14 is actuated in the direction in which the internal edge of the slot 15 engages an annular groove 16 of the pivot 8, thus preventing the case 9 from protruding.

The tab 14 has, at one end, an extension 17 which, when the edge of the slot 15 has entered the groove 16 of the pivot 8, engages a recess 18 which is formed at the edge formed by the flange 6 with the cup 4. The recess 18 affects both the inner rim of the flange 6 and the adjacent region of the cup 4, in order to be able to receive a hook-shaped lug 19 which is formed at the end of the extension 17. When the tab 14 has disengaged from the groove 16, the lug 19 enters a hollow 20 which is formed in the portion 10 of the case, proximate to the wall 11. In summary, when the tab 14 is in the position for engaging the groove 16 and the recess 18, the case 9 is retained inside the cup. Vice versa, when the tab 14 is in the position for disengagement from the groove 16 and from the recess 18, it is possible to remove the case 9 from the cup or insert it again.

The apparatus according to the present invention, as will become apparent hereinafter, automatically grips and actuates the tab 14 so as to allow the replacement of the case 9 that contains the empty bobbin with another case which contains a full bobbin.

In order to also allow manual extraction of the case 9, a lever 21 is provided which is articulated to the end of the tab 14 which lies opposite to the extension 17 by means of a pivot 22 which is driven through two lobes 23 of the tab 14. The lever 21 usually rests on the tab 14 and has, in a median region, a passage opening 24 for the end of the pivot 8 and, at its articulation end, an arm 25 which engages a slit 26 of the wall 11 of the case. It is evident that by lifting the lever 21, the arm 25 acts against the edge of the slit 26, causing as a reaction the movement of the tab 14 into the position for disengaging from the groove 16, which allows to extract the case 9 from the pivot 8.

The apparatus according to the present invention is substantially composed of a vertical shoulder 27 which is fixed to the carriage 1 and is provided with lightening openings.

A vertical lateral wall 28 and a lower horizontal plate 29 are rigidly coupled to the shoulder 27. The wall 28 and the lower plate 29 are perpendicular to the shoulder 27, so as to define a space into which the bracket 2 for supporting the hook assembly 3 protrudes.

Two superimposed blocks 30, 30*a* are fixed to the wall 28, and two parallel and vertical bars lie between said blocks and act as a guide for a slider 33. The slider 33 can be lifted and lowered by way of a transfer jack 34 which acts between the block 30 and the slider 33.

The slider 33 is provided with two horizontal guides which are perpendicular to the bars 31 and 32 and in which two respective rods 35 are guided (only the upper rod is shown in the drawing); said rods are connected one another, at one end, by a plate 36. The slider 33 has a mounting rib 33*a* for a driving jack 36*a*, the stem whereof being rigidly coupled to the plate 36, so as to cause its movement along the rods 35.

A pick-up element, generally designated by the reference numeral 37, is rigidly coupled to the plate 36, laterally to the guiding rods 35, and is adapted to grip and extract from the hook assembly 3 the case 9 whose bobbin is empty and replace it with a case which has a full bobbin, taken from an underlying rotary magazine generally designated by the reference numeral 38.

Figure 5:
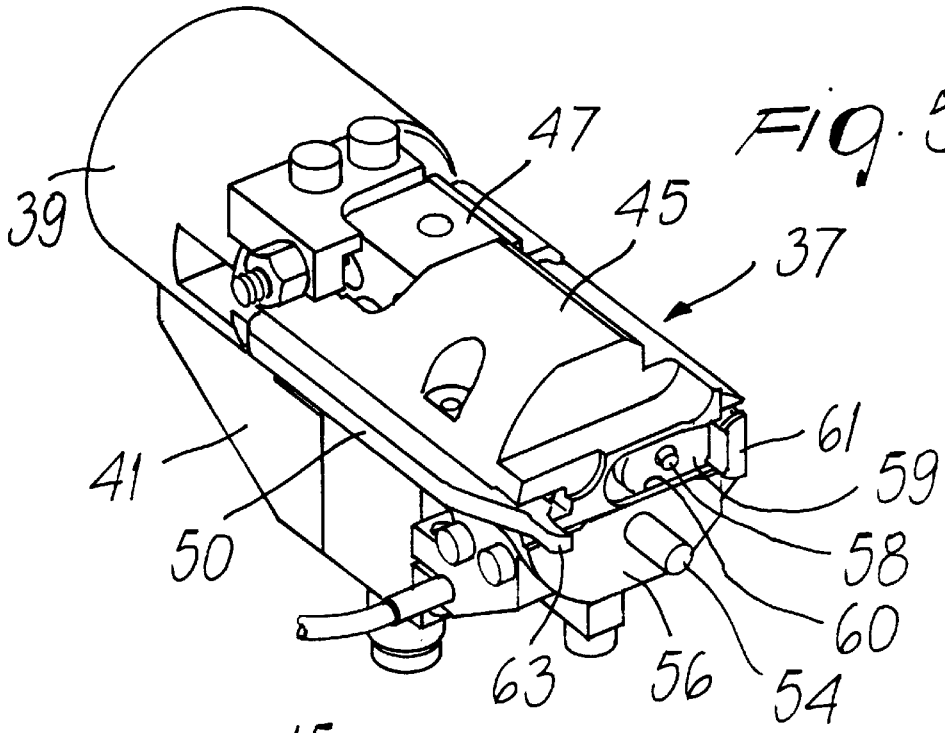
FIG. 5 is a perspective view of the element meant to grip the case in its seat.
Figure 6:
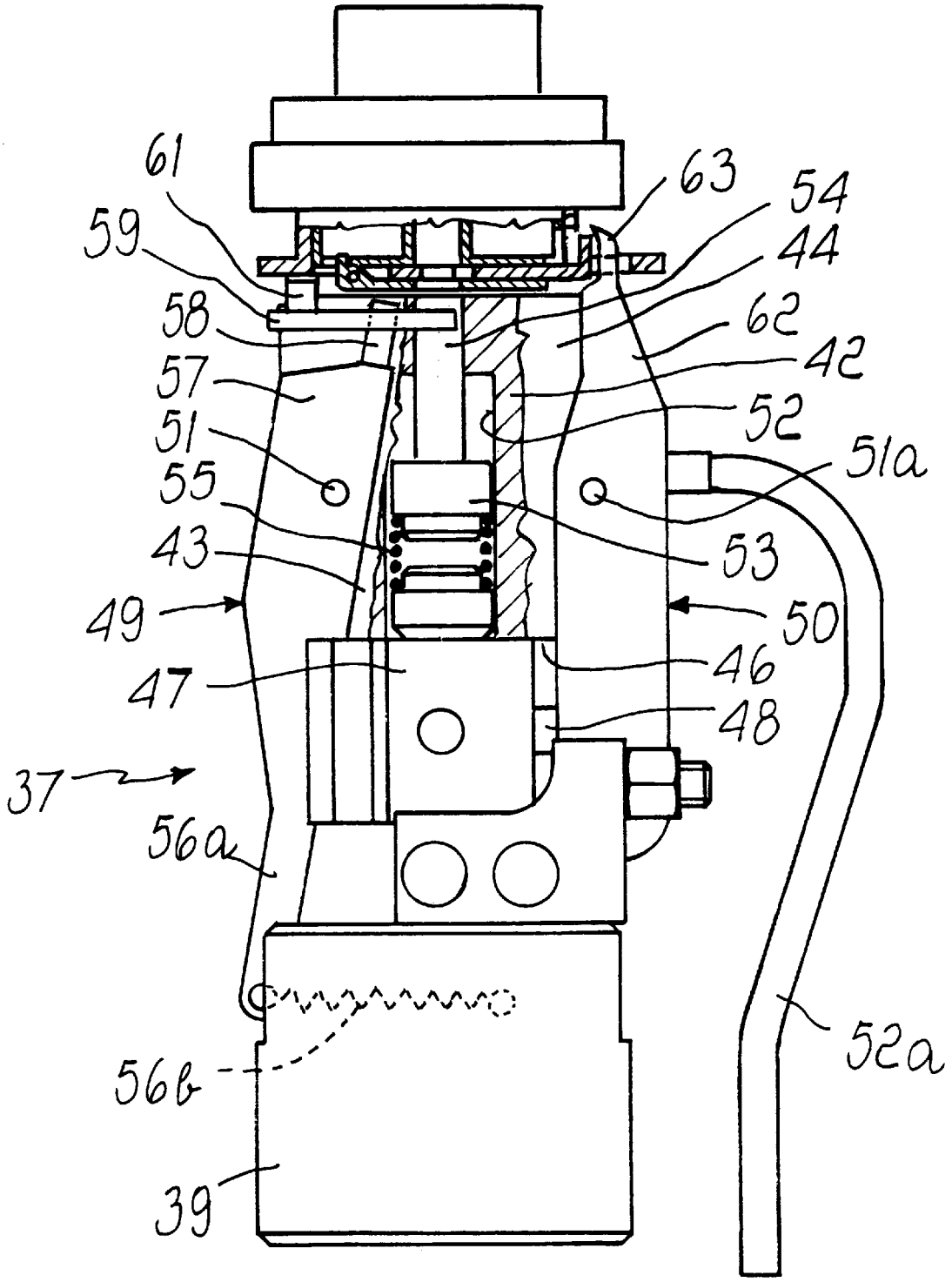
FIG. 6 is a view of the element of FIG. 5 in the position that precedes the retention of the case.
Figure 7:
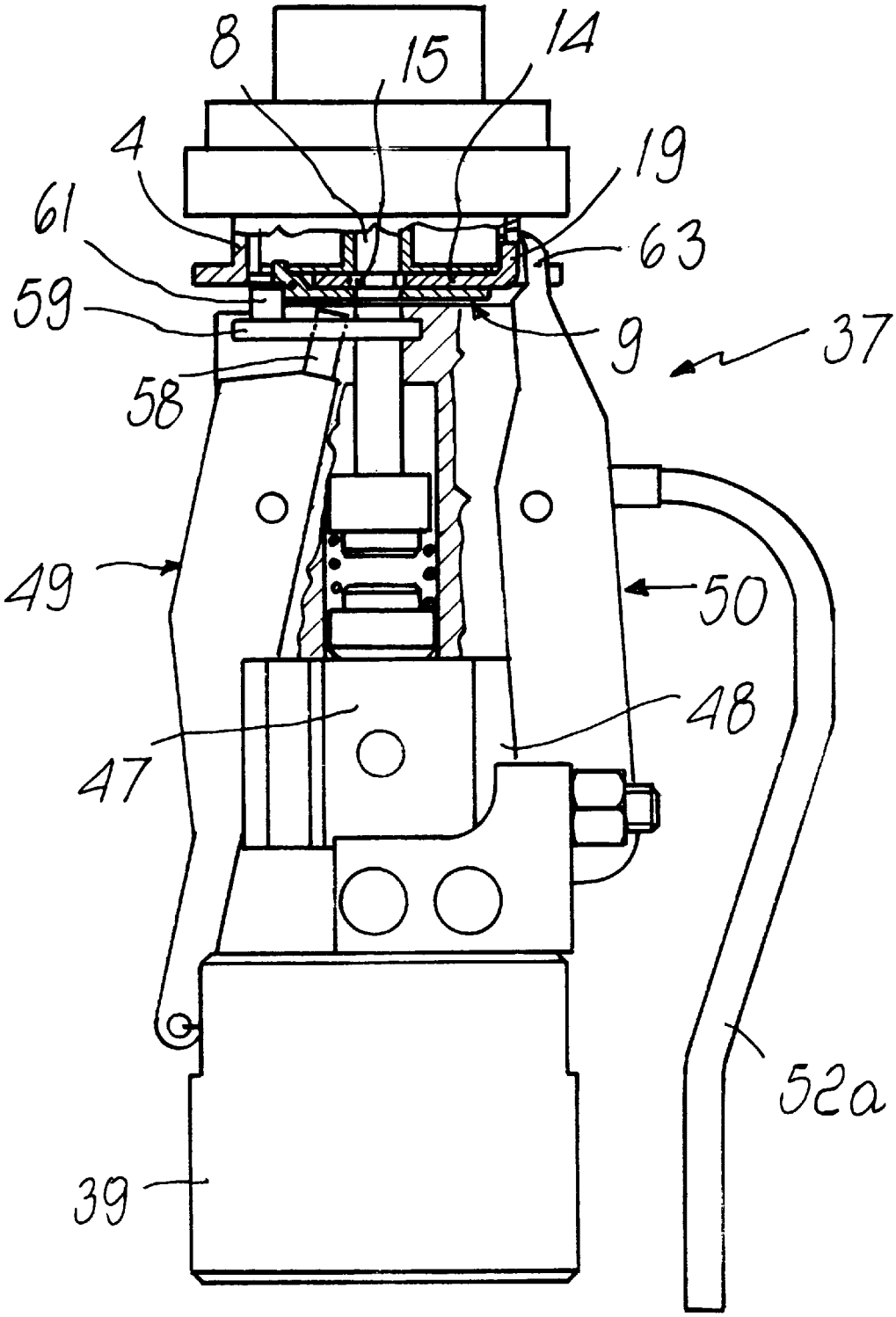
FIG. 7 is a view of the element of FIG. 5 in the position for gripping the case.

The pick-up element 37 (see FIGS. 5 and 6 in particular) comprises a substantially cylindrical body 39 which is adapted to be fixed to the plate 36 by means of a bolt 40. An element 41 is fixed, in a downward region, to the body 39, protrudes toward the plate 27 and has an upper face in which there is a median raised portion 42, which forms two lateral hollows 43 and 44. A cover 45 is fixed to the raised portion 42 and closes the hollows 43 and 44 in an upward region, leaving them open laterally.

In the element 41, proximate to the body 39, there is a transverse groove 46 which is connected to the lateral hollows 43 and 44 and in which the cylinder 47 of a jack is slidingly arranged; the stem of said jack is designated by the reference numeral 48. The cylinder 47 and the stem 48 act, on opposite sides, on a pair of levers 49 and 50 which are pivoted in a rocker-like manner about pivots 51 and 51*a* which are driven into the element 41 and pass through the cover 45.

A cylindrical seat 52 is provided in the raised portion 42 and can be connected, by means of a pipe 52*a*, to a compressed air feed, a piston 53 slides in said seat and is provided with a stem 54 which is actuated, by means of a spring 55, so as to protrude from the end face 56 of the element 41. The stem 54, as will become apparent hereinafter, is designed to expel the case 9 taken from the hook assembly 3 of the sewing machine during bobbin changes. The lever 49 has a first arm 56*a*, on which a traction spring 56*b* acts, and a second arm 57, which is extended by a pin 58 rigidly coupled to a plate 59. The plate 59 is guided in a seat 60 which is formed at the end of the element 41, at right angles to the stem 54.

The seat 60 is open at the front on the face 56 in order to allow a jaw 61, rigidly coupled to the outer end of the plate 59, to protrude outwards and follow its movements.

The jaw 61 is shaped so that when the pick-up element 37 is moved toward the case of the hook assembly 3 that must be replaced, said jaw can abut against the lobes 23 in which the lever 21 is articulated.

The lever 50, which is accommodated in the hollow 44, has an arm 62 which protrudes beyond the end face 55 with a claw-shaped end 63. The claw 63 is shaped so that it can enter the recess 18 of the flange 6 and of the cup 4 in order to be able to act from the outside toward the inside on the lug 19 of the tab 14 and move it into the position for disengaging from the pivot 8.

Once the pick-up element 37 has removed the empty case 9 from the hook assembly 3 and has unloaded it into an underlying container 64 as will be described in greater detail hereinafter, the same element 37 inserts a new case, taken from a magazine 38, into the hook assembly 3.

The magazine 38 is constituted in practice by a disk 65 (see FIGS. 1 and 2) which is supported so that it can rotate about a horizontal shaft 66 which cantilevers out from the shoulder 27 and lies on the same vertical plane that passes through the axis of the grip element 37. In order to axially retain the disk 65 on the shaft 66 or allow to remove said disk from said shaft, there is a key 67 which is articulated in a radial hollow of the shaft and is actuated by resilient means so as to protrude from the hollow when it must prevent the extraction of the disk from the shaft 66 or so that it can be pushed into the hollow when the disk 65 is to be extracted.

In the disk 65, along a circumference which is concentric to the shaft 65, there are cylindrical receptacles 68 which are angularly equidistant and exactly duplicate the shape of the cup 4 of the hook assembly 3 to allow the loading onto pins 69, arranged inside the receptacles 68, of a matching number of cases 9 which support full bobbins. The cases are loaded manually into the receptacles 68.

It should be observed that the receptacles 68 have notches which are fully similar to the recesses 18 and are adapted to receive the lugs 19 of the cases 9 in order to allow to orientate the cases so that the case that is at the top of the disk 65 has the same orientation as the case that is in the hook assembly 3.

The magazine 38 is actuated with an intermittent motion so that at every step of its rotary advancement of the case that must be picked up by the pick-up element 37 is always at the top of the disk 65.

In order to provide the intermittent advancement, the disk 65 can be coupled to an actuation sleeve 70 by means of a unidirectional articulation which allows the disk to rotate only in one direction. A radial arm 71 is rigidly coupled to the sleeve 70 and is articulately connected, at its end, to the stem 72 of a pneumatic jack, the cylinder 73 whereof is articulated to a post 74 rigidly coupled to the shoulder 27.

The actuation of the jack 72, 73, by way of the unidirectional articulation, makes the disk 65 perform an angular stroke which corresponds to the angular distance between the receptacles; at the end of said stroke, the disk is locked in order to allow the jack to reset in the initial position for the subsequent rotation. The return of the sleeve 70 into the reset position is allowed by the unidirectional articulation, which as mentioned is active only in the advancement direction.

The disk 65 is locked at the end of each angular stroke by means of a lever 75 which is articulated to a fork 76 rigidly coupled to the lower plate 29 and oscillates on the plane of the disk 65.

The lever 75 is provided, on the face directed toward the disk 65, with a wedge 77 which is adapted to engage, at the end of each angular stroke, in a respective notch of a plurality of notches 78 formed along the peripheral region of the disk 65. The notches 78 are angularly equidistant along the peripheral region of the disk 65 and their number is equal to the number of the receptacles 68. In order to keep the wedge 77 engaged in the respective notch 78, there is a traction spring 79 which is rigidly coupled to the lower plate 29 with one end and is rigidly coupled to an arm 80, rigidly associated with the lever 75, with its opposite end.

The disengagement of the wedge 77 from the respective notch 78 is actuated by a jack which lies below the lower plate 29 and acts on the lever 75 by means of a lever system. More specifically, the jack comprises a cylinder 81 which is articulated to a rib 82 rigidly coupled to the lower plate 29 and has a stem 83 which acts on a lever 84 which is guided through an opening 85 of the lower plate 29. The lever 84 is pivoted in a rocker-like manner at the opening 85 by means of a pivot 86, so as to have an arm 87, which lies under the plate 29 and to which the stem 83 is articulated, and an arm 88, which lies above the plate 29 and to the end of which a strip 89 is pivoted by means of a pivot 88*a*. A finger 90 is rigidly coupled to the strip 89 and is actuated, by means of a traction spring 91 whose opposite ends are rigidly coupled to the finger 90 and to the arm 88, into the position for abutment against the arm 88.

A roller 92 is mounted on the strip 89 so as to cantilever out from it. The roller 92 is designed to cooperate with an additional roller 93 which is mounted at the end of the lever 75 so as to cantilever out therefrom. The position of the roller 92 with respect to the fulcrum 86 of the lever 84 is such that when the jack 81, 83 is actuated so as to retract, causing the oscillation of the lever 84, the roller 92 abuts against the roller 93, causing the lowering of the lever 75 and the disengagement of the wedge 77 from the respective notch 78. It should be observed that the mutual abutment of the rollers 92 and 93 does not modify the position of the strip 89 with respect to the arm 88 due to the finger 90, which continues to rest on the arm 88.

When the roller 92 has moved beyond the roller 93, the spring 79 again lifts the lever 75 into the position in which the wedge 77 is in contact with the peripheral region of the disk 65, so that by rotating said disk the wedge 77 engages in the corresponding notch 78.

Vice versa, when the lever 84 is made to oscillate in the opposite direction, i.e., so as to elongate, the abutment of the roller 92 against the roller 93 causes the rotation of the strip 89 with respect to the arm 88, allowing the roller 92 to move beyond the roller 93 and then return to the initial position by means of the spring 91.

The operation of the described apparatus is as follows.

During quilting, when an appropriately provided sensor detects that the bobbin of the sewing machine is empty, the jack 36*a* is activated so as to make the pick-up element 37 advance toward the hook assembly 3 until it reaches a stroke limit position in which the claw 63 has engaged the recess 18 to the side of the lug 19 and the jaw 61 is arranged to the side of the lobes 23 of the tab 14. At the same time, the stem 54 of the piston 53, by abutting against the pivot 8 of the cup 4, retracts into the seat 52, loading the spring 55. This situation, shown in FIG. 6, clearly shows that the claw 63 and the jaw 61 are both still spaced from the lug 19 and from the lobes 23. When an appropriately provided sensor detects that this position has been reached, the jack 47, 48 is activated and, by expanding, causes the actuation of the levers 49 and 50 against each other, so as to grip the tab 14 at its opposite ends. In particular, the lever 49 performs an approach stroke toward the lobes 23 in order to allow the claw 63 of the lever 50 to act on the tab 14 and move the tab 14 against the jaw 61, in order to retain it in a vise-like manner. The movement of the tab 14 is adjusted so that the edge of the slot 15 of the tab leaves the groove 16 of the pivot 8.

Once this step for picking up the case 9 and releasing the tab 14 from the pivot 8 has been completed, the jack 36*a* is reactivated and, by moving the grip element 37 away from the bracket 2, causes the extraction of the case 9 from the cup 4.

The next step consists in lowering the carriage 33 to the level at which the pick-up element 37 is aligned with the receptacle of the magazine 38 which is at the top of the disk 65 and accommodates the case that contains the full bobbin.

Once this level has been reached, the jack 47, 48 is activated so as to widen the ends of the levers 49 and 50, allowing the picked-up case to be expelled from the stem 54 thanks to the spring 55 and to fall into the underlying container 64. While the ends of the levers are in this elongated position, the jack 36*a* is actuated again so as to advance until the claw 63 and the jaw 61 have reached the position for gripping the full case contained in the top receptacle of the magazine 38. The full case is picked up and extracted in the same manner described above, i.e., by moving the pick-up element closer and, after gripping the case, by retracting it again to then lift it to the level of the hook assembly and then move it closer to said hook assembly in order to complete the insertion of the full case in the cup 4.

After extracting the full case from the magazine 38, the disk 65 is rotated by a pitch which corresponds to the angular distance between the receptacles, so as to bring a new full case to the top of the disk 65. The rotation of the disk 65 is actuated by the jack 72, 73 after the jack 81, 83 has disengaged the wedge 77 from the notch 78 by means of the lever 84.

It is evident that the described apparatus fully achieves the intended aim and object.

Numerous modifications and variations are possible in the practical embodiment, and all are within the scope of the same inventive concept.

For example, the apparatus according to the invention, instead of being stably associated with the carriage for supporting the sewing machine, can be installed to the side of the quilting machine; the carriage will be actuated so as to bring the hook assembly into alignment with the pick-up element 37.

What is claimed is:

1. An apparatus for automatically changing bobbin cases which contain empty bobbins with bobbin cases which contain full bobbins, in a quilting machine including a movable carriage on which a sewing machine is supported, the sewing machine having a hook assembly composed of a cup for accommodating a bobbin case, a pivot, and a tab, said case being supported by said pivot which is located inside said cup, with said tab being guided at right angles to said pivot and being movable between a position for engagement on an annular groove of said pivot in order to retain said case inside said cup and a position for disengagement from said pivot in order to allow to extract the case from said cup; the apparatus comprising: a rotating magazine containing full cases, being supported on said carriage so as to be rotatable about a horizontal axis thereof, said magazine being provided with a plurality of receptacles mutually equidistant along a circumference which is concentric to said axis, each one of said receptacles having a respective pivot for supporting a respective full case; rotation means for rotating said magazine with a pitch being equal to an angular distance between two successive said receptacles; a case pick-up element; transfer means on which said pick-up element is mounted for transfer between a first position, in which the pick-up element is aligned with said hook assembly, and a second position, in which said pick-up element is aligned with a receptacle of said magazine containing a full case; a collection container; and actuation means for actuating said pick-up element into said first and second positions for gripping and extracting an empty case contained in said hook assembly, depositing the empty case in the collection container, and respectively, for gripping and removing a said full case from said receptacle and transferring the full case into said hook assembly.

2. The apparatus of claim 1, wherein said pick-up element comprises: a body which is rigidly coupled to said transfer means; first and a second levers articulated on said body; an actuator for opening and closing said levers, the first one of said levers having an end thereof which is shaped so as to engage an end of said tab when said pick-up element is actuated into a said position for gripping a case, and the second one of said levers being provided with an end thereof which forms a jaw for abutting said tab in a position for locking and disengaging said tab from said pivot supporting said case.

3. The apparatus of claim 2, comprising a plate which is guided in a seat of said body, said plate being rigidly coupled to the end of said second lever, and said jaw being rigidly coupled to said plate.

4. The apparatus of claim 2, wherein said actuator is constituted by a jack guided in a groove provided at said body, said groove being substantially perpendicular to said levers, and said jack comprising a cylinder acting in abutment on a first one of said levers, and a stem acting on a second one of said levers.

5. The apparatus of claim 4, comprising: a further seat formed between said first and second levers; a piston being slideable in said further seat; a spring for loading said piston; and a stem provided at said piston, to protrude between said ends of said levers, with said stem acting on said case for moving said case away from said pick-up element when said levers release said case.

6. The apparatus of claim 2, wherein said magazine comprises a disk which is rotatably supported on said horizontal axis which is rigidly coupled to said carriage, said disk being provided with said plurality of receptacles which are angularly equidistant along a circumference which is concentric with respect to said axis, said receptacles being each provided with the respective said pivot for supporting the full cases; wherein said rotation means comprises a sleeve which is mounted coaxially on said axis and is coupleable to said disk by way of a unidirectional articulation; and wherein the apparatus further comprises: a radial arm being fixed to said sleeve; a jack acting on said arm, said jack moving said disk so as to perform an angular stroke which corresponds to the angular distance between the receptacles; and locking means for locking said disk at an end of each angular stroke.

7. The apparatus of claim 6, comprising a plurality of equidistant notches formed along a peripheral region of the disk, the number of said notches being equal to the number of said receptacles, and wherein said disk locking means comprise elastic means, a lever system, an actuation jack, and a lever which is articulated to said carriage and is provided with a wedge for engaging, at the end of each angular stroke, in a said respective notch, said wedge being kept engaged in the respective notch by said elastic means which act on said lever, and being further disengageable by way of said lever system which acts on said lever and is actuated by said actuation jack.

8. The apparatus of claim 7, comprising: a strip, a loading spring and rollers, said lever system comprising a rocker lever which is articulated in a rocker-like manner in said carriage, said rocker lever having a first arm, which is actuated by said actuation jack, and a second arm at an end of which said strip is pivoted, with said strip having a finger which, by way of said loading spring, is kept in abutment against said second arm, respective rollers being mounted on said strip and on said lever to which said wedge is fixed, whereby when said rocker-like lever is actuated in a first direction the roller on the strip abuts against the roller on the lever of the wedge and causes the movement thereof and disengagement of the wedge from a said respective notch, and when said rocker-like lever is actuated in a second opposite direction the roller on the strip, by abutting against the roller on the lever of the wedge, causes rotation of the strip, allowing the corresponding roller to move into an initial position without moving the lever of the wedge.

9. The apparatus of claim 8, wherein said transfer means comprise: a slider; a transfer jack; a driving jack; guiding elements for guiding said slider to move under effect of said transfer jack, between said positions in which said pick-up element is aligned with said hook assembly and with said receptacle, respectively; and a support for said pick-up element which is guided on said slider, said support being actuated by said driving jack between said positions for gripping and extracting said cases from said hook assembly and from said receptacle.

* * * * *